US005909842A

United States Patent [19]

Allmon

[11] Patent Number: 5,909,842

[45] Date of Patent: Jun. 8, 1999

[54] CONTAINER FOLDING MACHINE AND PRODUCT THEREOF

[76] Inventor: Gary Allmon, 8426 Broadview Rd., Broadview Heights, Ohio 44147

[21] Appl. No.: 08/778,109

[22] Filed: Dec. 21, 1996

Related U.S. Application Data

[63] Continuation-in-part of application No. 08/624,074, Mar. 29, 1996, abandoned.

[51] Int. Cl.[6] ..... B65D 3/10

[52] U.S. Cl. ..... 229/404; 229/5.5; 229/400

[58] Field of Search ..... 229/4.5, 505, 104, 229/110, 116.1, 128, 137, 138, 184, 400, 404, 922

[56] References Cited

U.S. PATENT DOCUMENTS

| | | | |
|---|---|---|---|
| 648,448 | 5/1900 | Wagnitz | 229/138 |
| 3,272,418 | 9/1966 | Morse et al. | 229/400 |
| 3,713,576 | 1/1973 | Goebel | 229/4.5 |
| 3,977,594 | 8/1976 | Swan | 229/184 |
| 4,208,954 | 6/1980 | Chase | 229/110 |
| 4,712,725 | 12/1987 | Moore | 229/404 |
| 5,558,272 | 9/1996 | Magister | 229/138 |

FOREIGN PATENT DOCUMENTS

| | | | |
|---|---|---|---|
| 610683 | 10/1948 | United Kingdom | 229/400 |

*Primary Examiner*—Gary E. Elkins
*Attorney, Agent, or Firm*—Joseph H. Taddeo

[57] ABSTRACT

A machine for container formation by folding a die-scored paperboard structure to close flaps shaped by the scoring that serve as the top and bottom of the container. A scored paperboard sheet is loaded onto a male pedestal inner pattern such that the foldable top and bottom container portions extend beyond the pattern, whereupon armature driven semicircular outer patterns, having upper and lower fingers adapted to be driven by corresponding fluid driven pin stabilizers, close upon the sheet. While closed over the sheet, the pins are activated to move the fingers inward on the inner pattern and force fold the container along the score lines, followed by automatic retraction of the pins and outer patterns. The container is thus pre-folded in preparation for shipping as a flat paper form that is ready for folding on the crease lines thus formed. One or both flaps of the container can be folded along the crease lines to form a closure at one or both ends. When folded, the flap forms a plurality of inwardly directed pyramidal segments that are crimped along the container axis to form the closure.

17 Claims, 13 Drawing Sheets

CONTAINER FOLDING MACHINE AND PRODUCT THEREOF

REFERENCE TO PREVIOUSLY FILED APPLICATIONS

This is a Continuation-in-Part of Application Ser. No. 08/624,074, filed Mar. 29, 1996, now abandoned. Your applicant respectfully claims the benefit of that earlier patent filing date, Mar. 29, 1996, in the United States under 35 U.S.C. §120, and 37 CFR §1.53a.

FIELD OF THE INVENTION

The invention relates to a machine for folding containers, and more particularly to an improved machine for folding a die-scored box blank along score lines impressed by the die. The invention also relates to a prefolded container blank and an assembled container with one or both ends closed with a fanfold closure.

BACKGROUND OF THE INVENTION

Advances in technology now enable construction of containers form a broad variety of materials that may be laminated or otherwise coated. A box folding procedure may be followed in succession by a sealing process, dependent on whether the container is intended for storage of dry or liquid contents.

The initial activity in box folding is scoring the container blank to form segments or box sections that are divided by weakened points which are the score lines. The prior art folding procedure generally provides for advancing container blanks along a conveyor belt to a backing bar where a folding belt engages a box flap edge to fold the flap onto a container panel. The container blanks are thus folded along their score lines for box formation with the designed segments or sections.

The paramount considerations for box folding machines is speed of the operation and minimizing process interruptions, for effective reductions in manufacturing costs.

Therefore, a need exists for a paper box folding apparatus that would enable simple manual alignment of the box blank on the backing bar to form properly proportional segments according to the box design; that would give folds on the score lines to avoid skewing; and, to achieve the folding process with paramount speed and a minimum of interruptions in the process. In addition to the foregoing, a need exists for an inexpensive paper board container that is easy to assemble and close. These are among the objectives that are achieved by the invention disclosed herein.

SUMMARY OF THE INVENTION

An object of the present invention is to pre-form a plurality of prescored fanform flaps for a container closure speedily and with minimal interruptions to permit subsequent completion of the closure manually or by other means.

Another object is to prepare a prefolded closure for a cylindrical or frustum-shaped container blank whereby subsequent closure of the container is facilitated.

Still another object is a cylindrical or frustum-shaped container having a closure at one or both ends comprising a plurality of fanform pyramidals.

These and other objects are accomplished according to the teachings of the present invention by the use of a container folding machine for construction of containers using box blanks having score lines, in preparation for shipping the containers ready for completion of the container formation by manual folding. The machine comprises a male pedestal in a fixed position that serves as an inner pattern adapted to receive a box blank installed on the inner pattern; a press comprising an outer pattern for closure over the inner pattern with a box blank therebetween; and, a means to crease the paperboard along its score lines for formation of a prefolded container. The pedestal comprises upper and lower edges, and repositioning pedestal fingers pivotally connected along at least one of the edges by pedestal hinges. The hinges are spring loaded to bias the hinges and the fingers between a normal upright position and an inward positions. The press comprises two or more press sides which forms the outer pattern. The press sides include repositioning press fingers that are joined to the press sides by flat hinges and are adapted for inward movement against the inner pattern. Springs interconnect each finger with the press side to which it is hinged to maintain the finger in a normal upright position. An armature controls movement of each press side for closure upon and withdrawal of the press side from the box blank installed on the pedestal. The press includes a hydraulic or pneumatic actuated pin adjacent to a corresponding press finger for engaging the finger to drive the finger inward to contact and to crease the box blank along a score line. Each of the pins is mounted on one or more pin stabilizers surrounding the press and located near the top and/or bottom periphery of each press side. All pins on one stabilizer are connected to a common fluid lead line for simultaneous action thereof. The machine further may include a loading track for positioning a box blank directly adjacent the pedestal and a driver shaft for repositioning a box blank from the loading track for installation on the pedestal.

A further embodiment of the present invention is a machine for prefolding one end of a container blank along score lines, said container blank having an interior surface and an exterior surface. The machine contains a plurality of hinged spring-biased pedestal fingers positioned at spaced intervals around a central pedestal and joined thereto by spring-loaded hinges at spaced intervals, and a plurality of press fingers spaced intermediate said pedestal fingers. Means are included to bias each of the press fingers about a flat hinged from their normal position toward the interior of the container blank and to return the pins to their normal position. The pedestal fingers are adapted to be positioned around the interior surface of the container blank and the press fingers adapted to be positioned around the exterior surface of said blank. The fingers on the press and the pedestal are in the shape of a triangle, generally an isosceles triangle and conform in shape to the score lines on the container blank.

In yet another embodiment, the present invention comprises a container blank in the shape of a frustum or a cylinder for use as a the container comprising a body having at least one opening at one end thereof. The blank contains a plurality of creases to be folded into fanfold ribs around the opening. The creases are formed by the steps of creating a plurality of score lines around the periphery of the opening to form contiguous triangles; placing the blank in a creasing machine containing a plurality of triangular fingers whereby the fingers are in registry with the contiguous triangles; and actuating the fingers to form creases in the blank along the score lines around the opening. The fingers are composed of a plurality of press fingers spaced apart from one another around the outside of the opening of the container blank, and an equal number of pedestal fingers intermediate the press fingers around the inside of the opening of the blank. The press fingers cause the periphery of the opening to move in on itself, and the pedestal fingers resist the inward movement of the periphery thereby creating the creases.

In yet another embodiment of the invention, a container having a closure at one end is composed of a plurality of fanfold ribs round the periphery of the container. The ribs are formed by steps of a) preparing a container blank in the form of a frustum or a cylinder; b) creating a plurality of score lines around the periphery of the container blank to form contiguous triangles; c) placing the container blank in a creasing machine containing a plurality of triangular hinged fingers whereby the fingers are in registry with the triangles; d) activating the fingers to form creases along the score lines; e) removing the container blank from the machine, and f) folding the periphery of the container blank along the creases to form a plurality of inwardly directed ribs serving as the closure for the container. The container can have a circular or frusto-conical cross section whereupon each of the triangles around the periphery thereof comprises an isosceles triangle having a height equal to the radius of the closure. The fingers are composed of a plurality of press fingers spaced apart from one another around the outside of the container blank, and an equal number of pedestal fingers intermediate the press fingers around the inside of the container blank.

In still another embodiment of the present invention, a container is described which is cylindrical or frustoconical in shape. The container has a central axis and peripheral borders at either end defining fold lines. At least one of the two ends is closable with a fanfold closure which comprises a plurality of pyramidal segments, each segment composed of a first set of two isosceles triangles with their bases forming a portion of the end fold line and a second set of two isosceles triangles with their bases forming an axially extending crimp line. All of the triangles have a height equal to the radius of the container at the closure. The bases of the first set of triangles are contiguous to one another along the end fold line, and adjacent triangles form divergent planes as they extend from the base to the axis. Adjacent triangles in the second set diverge from one another as they extend from the container axis to the end fold line, each triangle terminating along the fold line at the intersection between the bases of contiguous triangles in the first set. The two sets of triangles are at right angles to the second set. The pyramidal segments are in non overlapping relationship to one another. Each end fold line is in a single plane, and the peripheral edge of the container blank before forming the closure is in a single plane.

Additional features of this invention will become apparent as indicated herein. And further advantages will be apparent to those of ordinary skill in the art upon reading and understanding the following detailed description.

DETAILED DESCRIPTION OF THE PREFERRED EMBODIMENT

Figure 1:
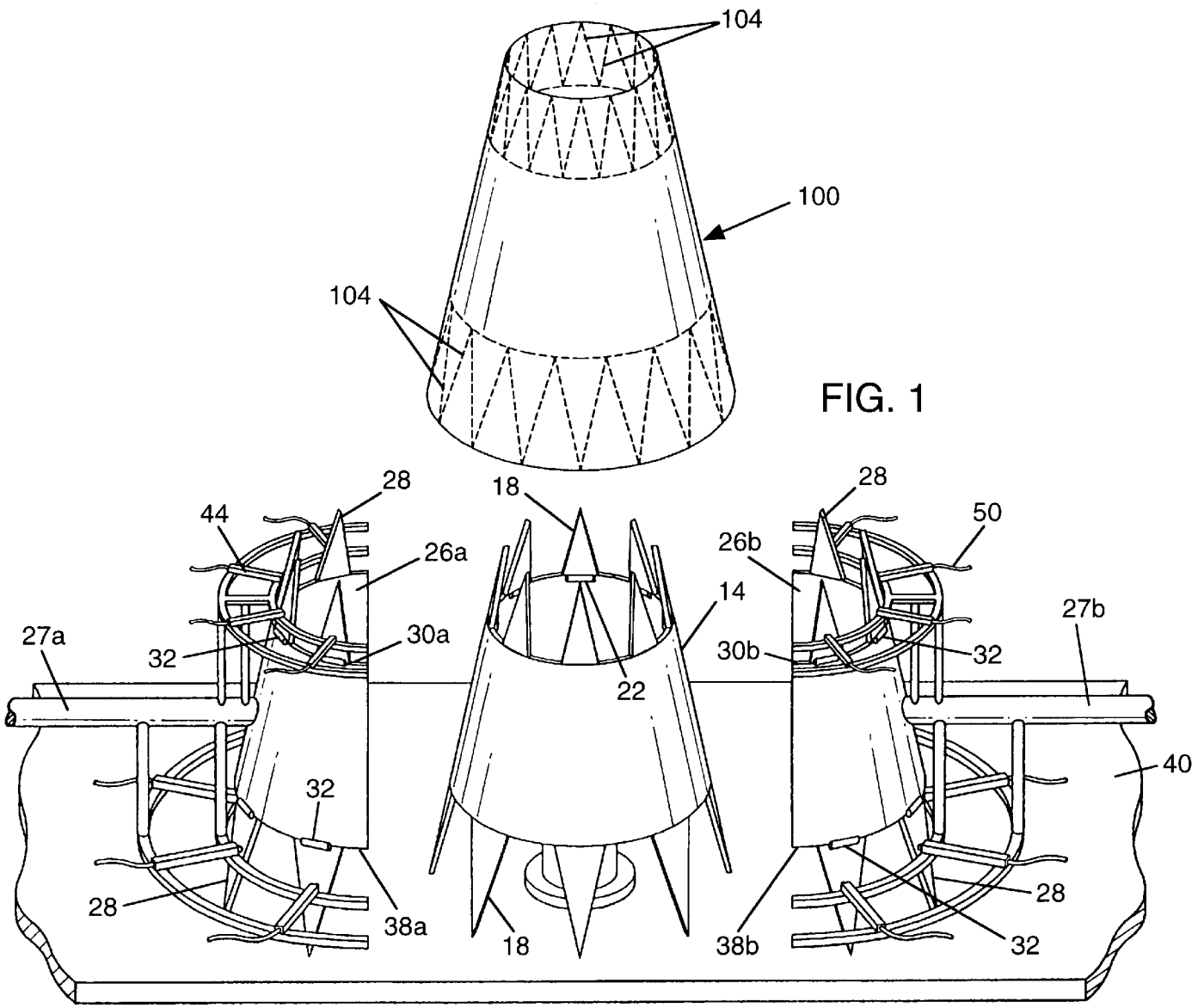
FIG. 1 is an elevation view in perspective with the box blank descending on the pedestal inner pattern with the press sides ready for closure.

It will be understood by Reference to FIG. 1, that the container folding machine 10 disclosed herein comprises a central pedestal 14 having upper edge 20 and lower edge 24. A plurality of triangles repositioning pedestal fingers 18 are pivotally joined to, and extend upward from upper edge 20. Additional repositioning pedestal fingers are pivotally joined to and extend downward from the lower edge 24 of the pedestal. The central pedestal 14 forms an inner pattern which serves as a backing bar or plate for each of the box blanks 100 that is processed for folding.

In FIG. 1, a frusto-conical box blank 100, having score lines 104, is positioned on the pedestal 14 that is an inner pattern with the press sides 26A, 26B ready for closure. Each of the pedestal finger 18 is adapted for inward movement in the folding process and return to its upright position by its interconnection with the pedestal 14 with spring loaded hinges 22, such that each pedestal finger 18 is normally in the upright position.

Figure 2:
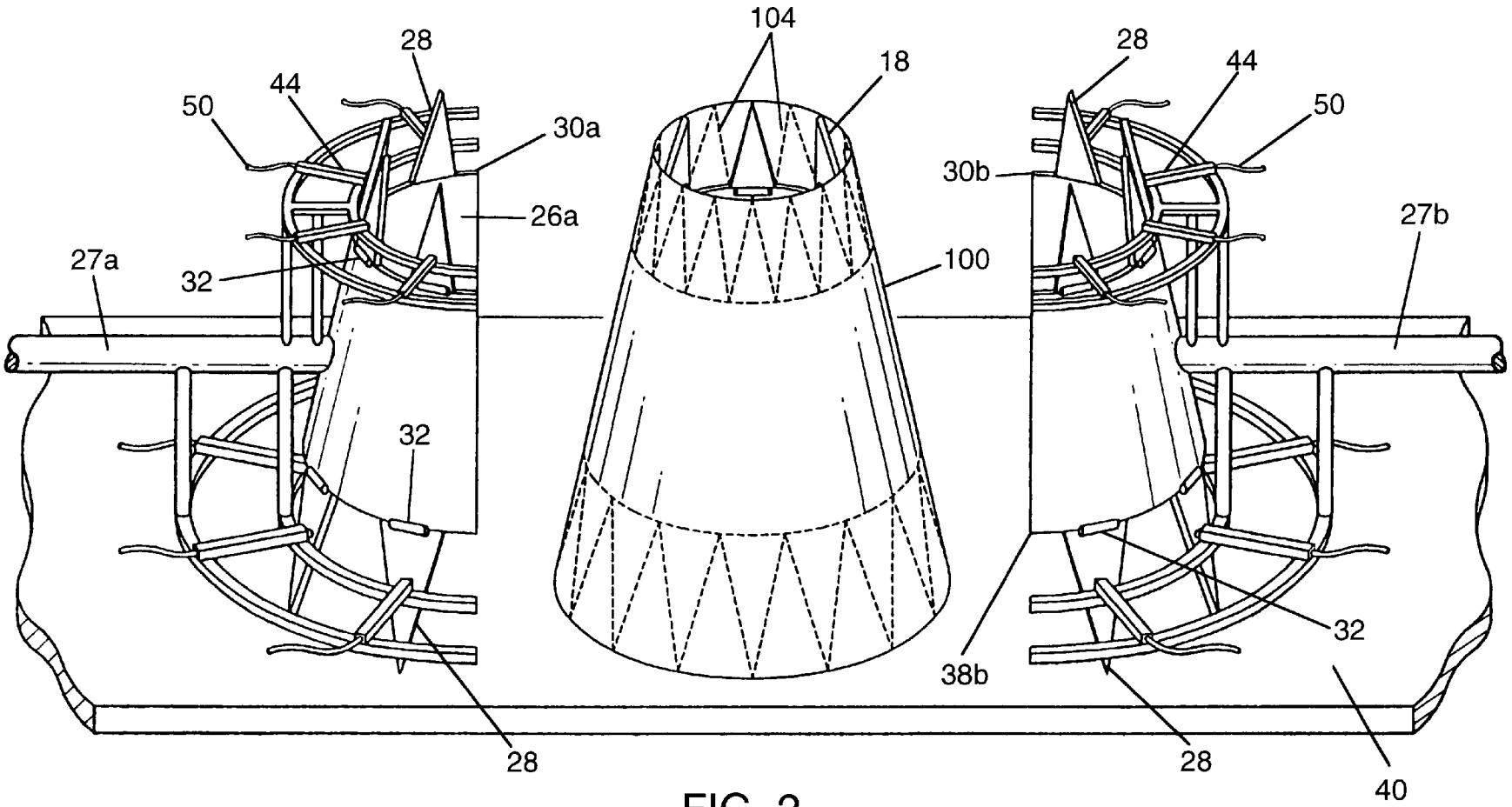
FIG. 2 discloses the folding machine with the blank installed on the pedestal.

Referring to FIG. 1 and FIG. 2, the press sides 26A, 26B, are corresponding shaped to fit over the pedestal 14. The press sides 26A, 26B form an outer pattern that is adapted for closure over the inner pattern to crease the box blank 100, which is preferably a paperboard material, along its score lines 104 for formation of a pre-folded container 108. The press sides have a top periphery 30A, 30B and a bottom periphery 38A, 38B.

It will be understood that while the pedestal 14 shown here is a frustum, the pedestal 14 may have cylindrical, square, rectangular, multi-sided or other forms for construction of similarly shaped boxes with one or more collapsible, reclosable ends. Furthermore, the triangular pedestal fingers 18 shown here, may have other shapes analogous to the top and bottom segments of a particular die-cut box blank 100.

Each of the press sides 26A, 26B is also equipped with projecting, repositioning press fingers 28, that are each triangular in shape and are adapted for inward movement by interconnection to the top periphery 30A, 30B and the bottom periphery 38A, 38B of each press side 26A, 26B, by means of a flat hinge 32. When the press sides close around the pedestal, the triangular press fingers and the pedestal fingers are in alternate positions around the peripheral edge of the box blank.

Movement of the press sides 26A, 26B is controlled by a respective armature 27A, 27B, connected to a central joint or knuckle (not shown), that allows the armatures to move in and out, e.g. by operation of foot pedals (not shown), for closure upon, and withdrawal from, the pedestal 14. Meanwhile, pedestal 14 is fixed in stable position upon a horizontal deck 40.

Figure 3:
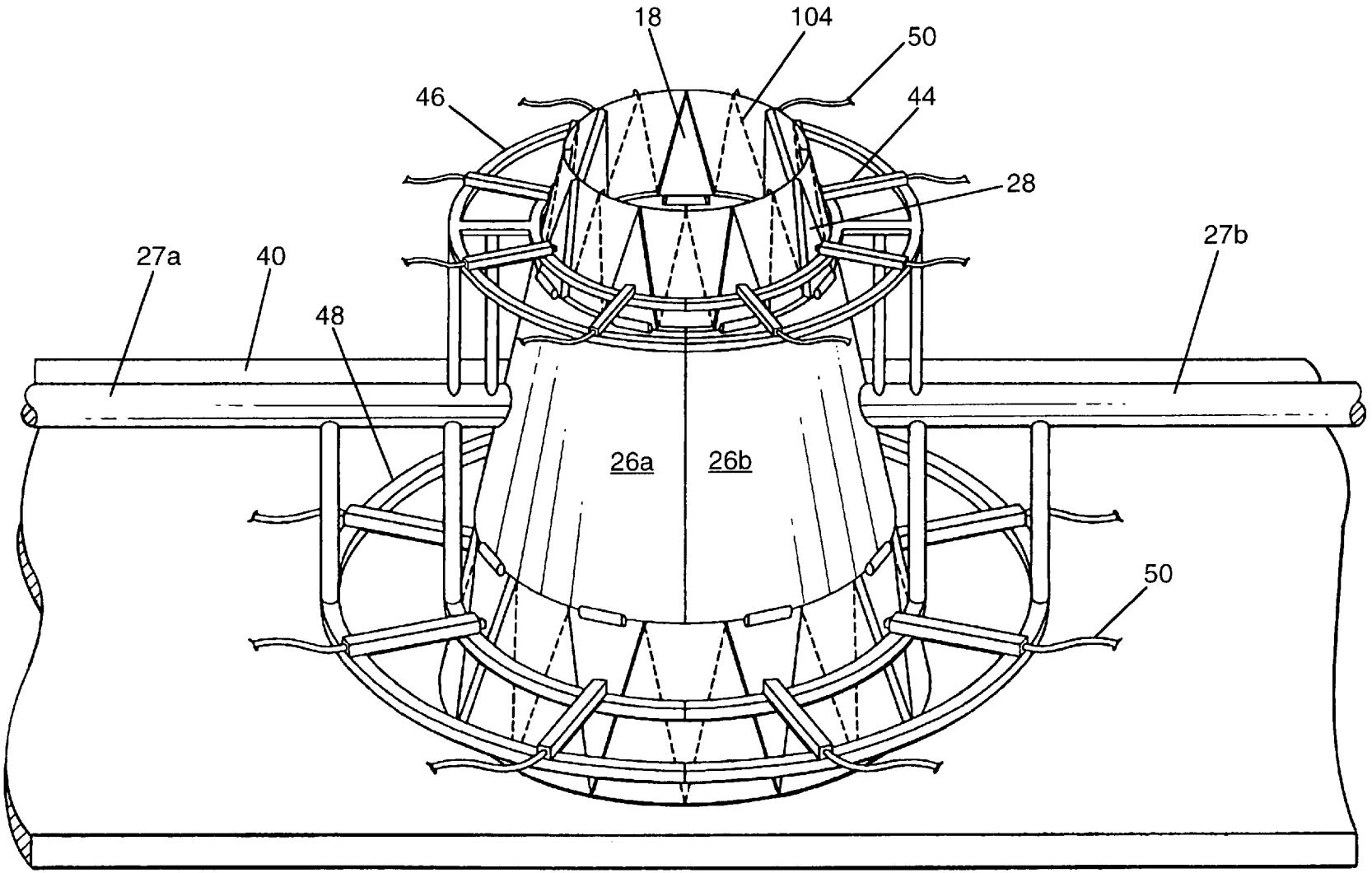
FIG. 3 shows the equipment in operative condition with the press sides closed over the container blank on the pedestal.
Figure 4:
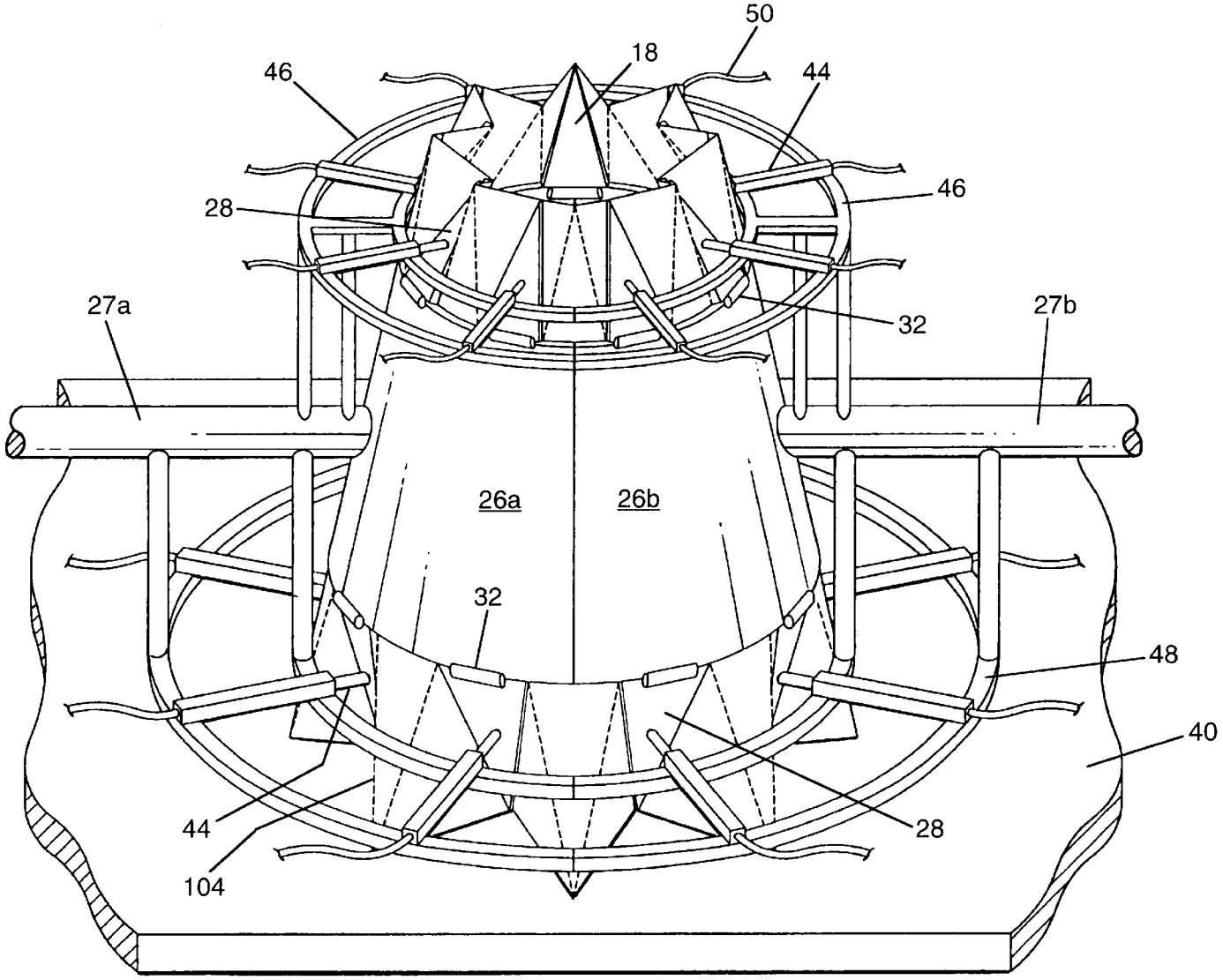
FIG. 4 shows the operative state of the equipment when the press is closed and the contact fingers pressured inward.
Figure 5:
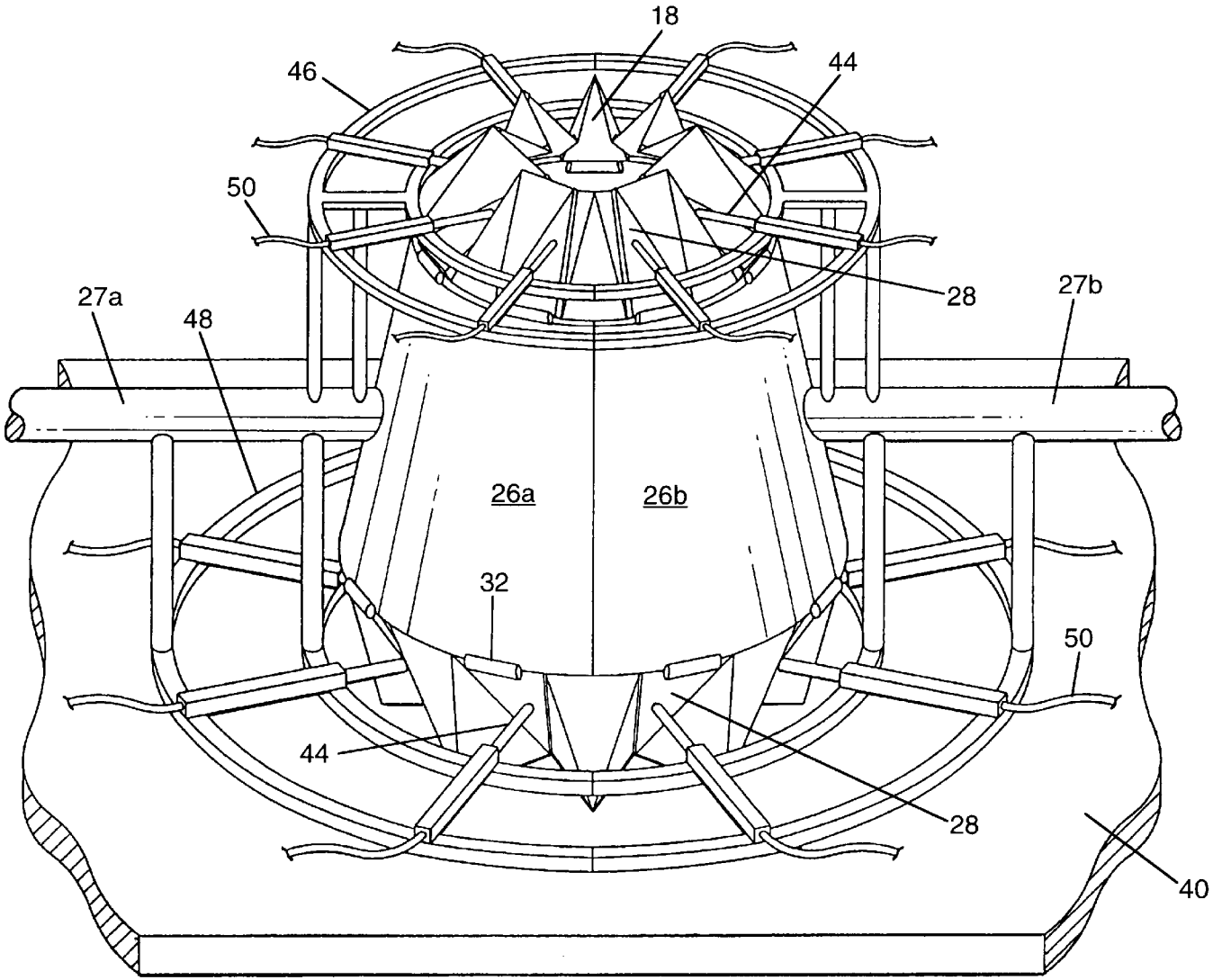
FIG. 5 shows the machinery in operation when the press is closed, the contact fingers pressured inward, and the fingers are fully engaged to form creases to pre-fold the box.

The box blank is aligned for conformity of its segments with the pedestal fingers 18, upon installation on the pedestal as illustrated in FIG. 3, FIG. 4, and FIG. 5. When the press sides 26A, 26B are closed over the pedestal 14, with the box blank 100 therebetween, then pins 44 that are mounted on upper and lower pin stabilizers, 46, 48 of each of the press sides 26A, 26B, and positioned adjacent a corresponding press finger 28 thereof, are simultaneously driven inward. Each pin 44 communicates through its respective lead line 50 to a common line (not shown) that communicates with a fluid container or tank (not shown) holding a fluid medium under pressure.

The preferred fluid medium is compressed air to provide the force necessary to drive the pins 44 inward; and, each of the pins 44 is in fluid communication with the others through the common line for simultaneous action of the pins 44 engaging respective press fingers 28. When the pins 44 have fully engaged fingers 28, the box creases are formed on designated score lines 104 for consequent pre-folding of each box.

Figure 6:
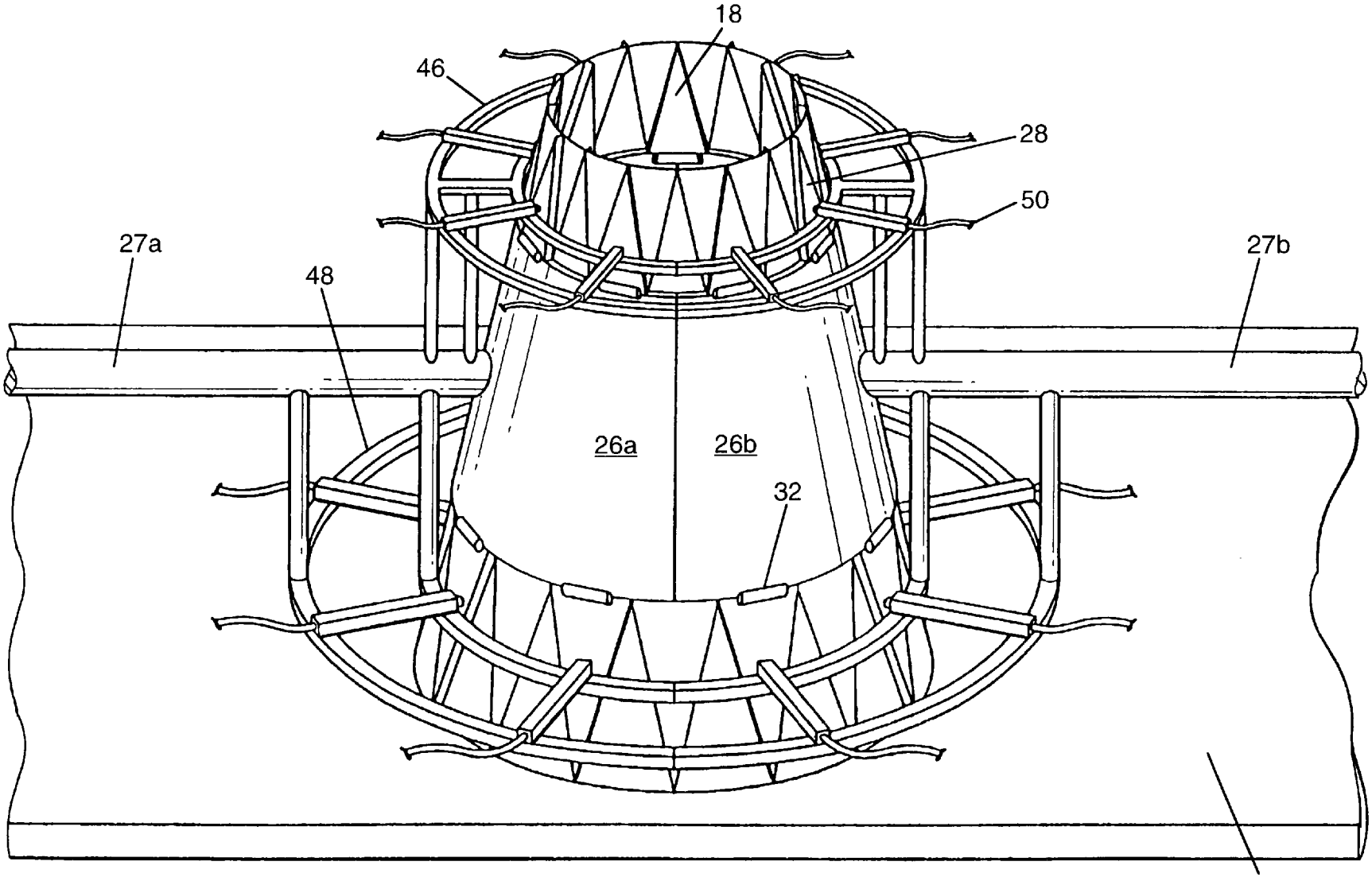
FIG. 6 discloses the equipment having the fingers withdrawn after the box has been pre-folded and prepared for manual closure.
Figure 7:
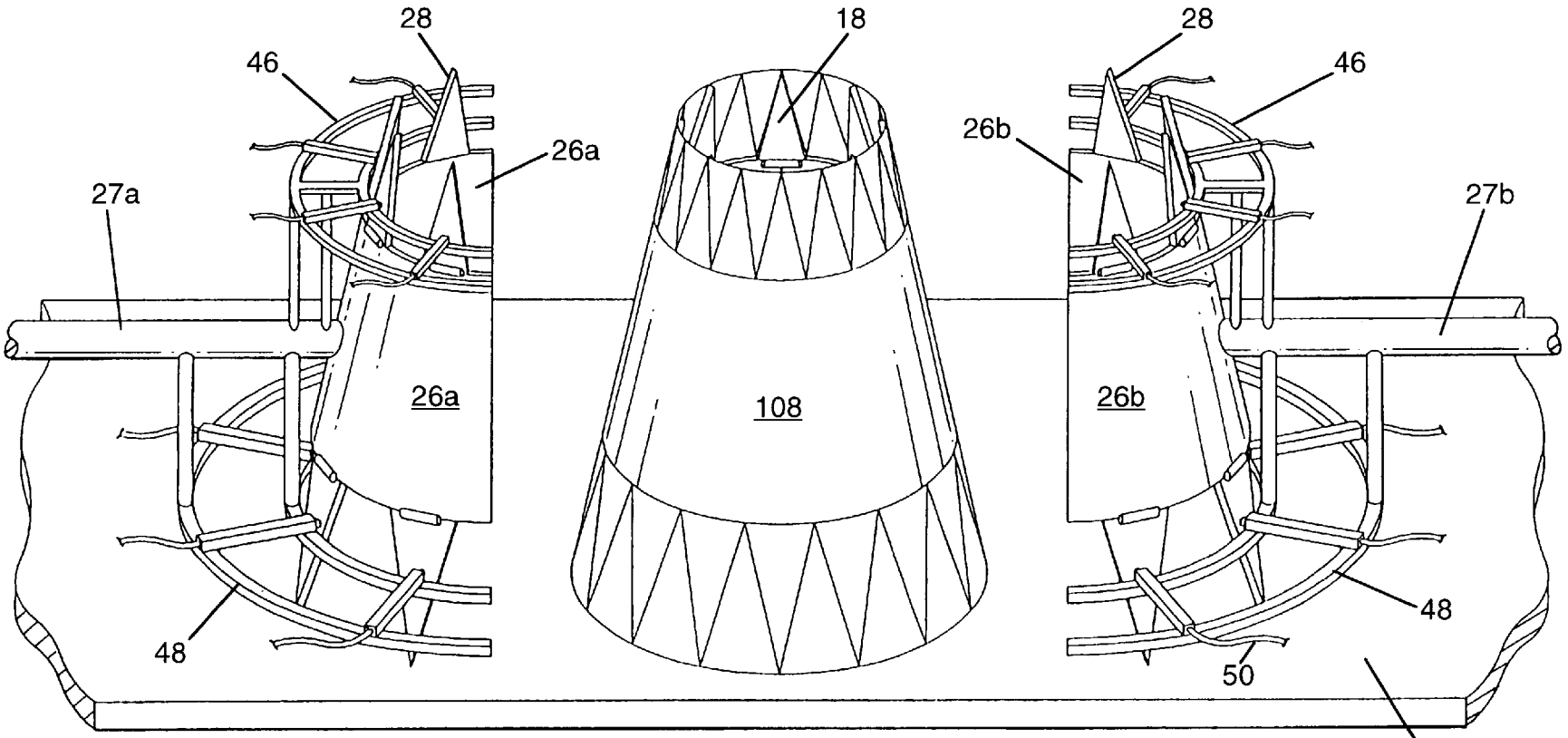
FIG. 7 discloses the equipment when the press sides have been withdrawn.

Referring now to FIG. 6, and FIG. 7 following their full engagement with the fingers 28, the pins 44 are withdrawn to facilitate removal of the pre-folded box 108, that is now prepared for closure on machine made crease lines corresponding to the score lines 104.

Figure 8:
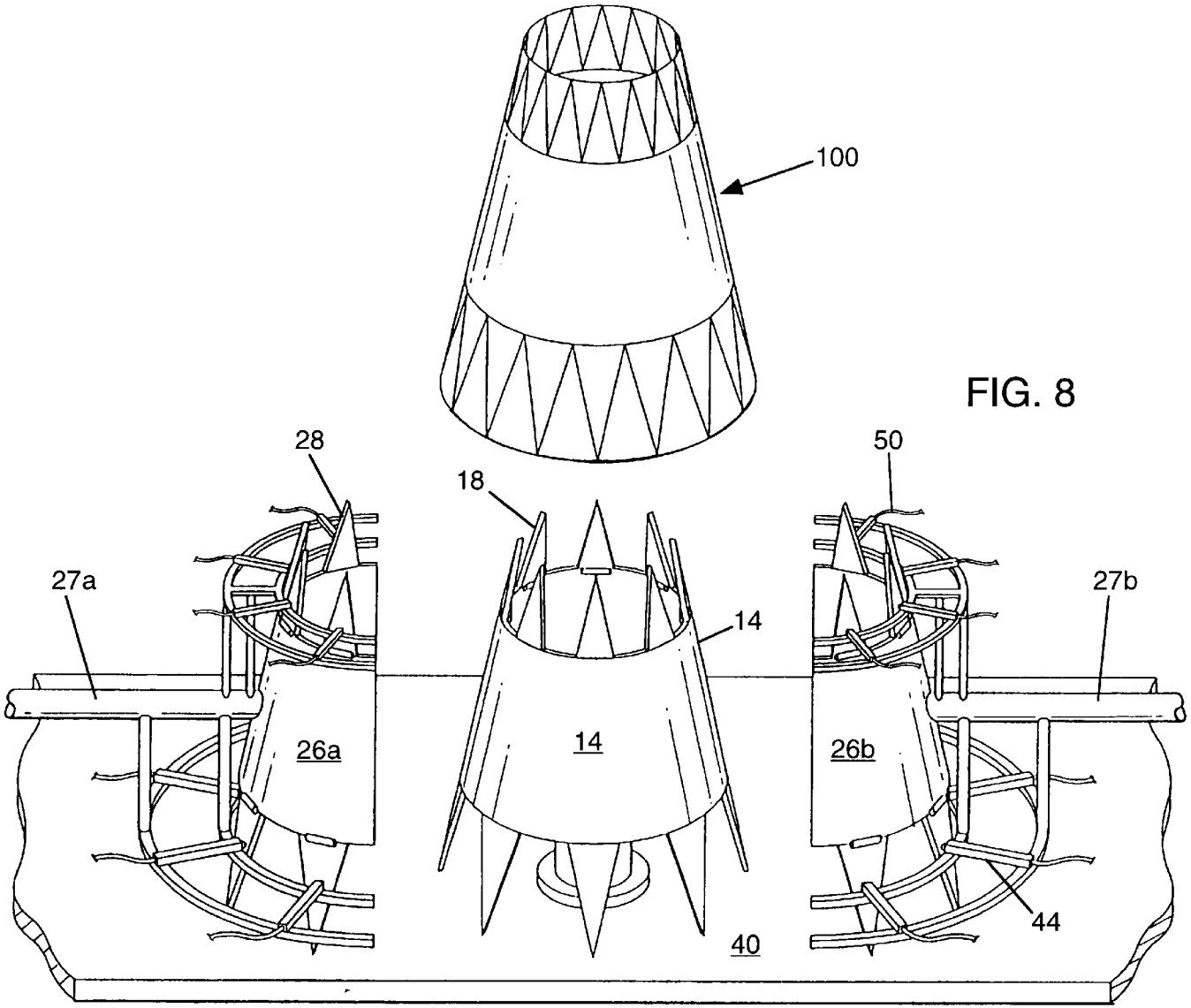
FIG. 8 discloses removal of the pre-folded box and readiness of the machinery for installation of another blank on the pedestal.

As disclosed in FIG. 7 and FIG. 8, the press sides 26A, 26B, are then withdrawn by radial movement of the armatures 27A, 27B, to facilitate removal of pre-folded box 108, in readiness for installation of the succeeding box blank 100 on the pedestal 14.

Figure 9:
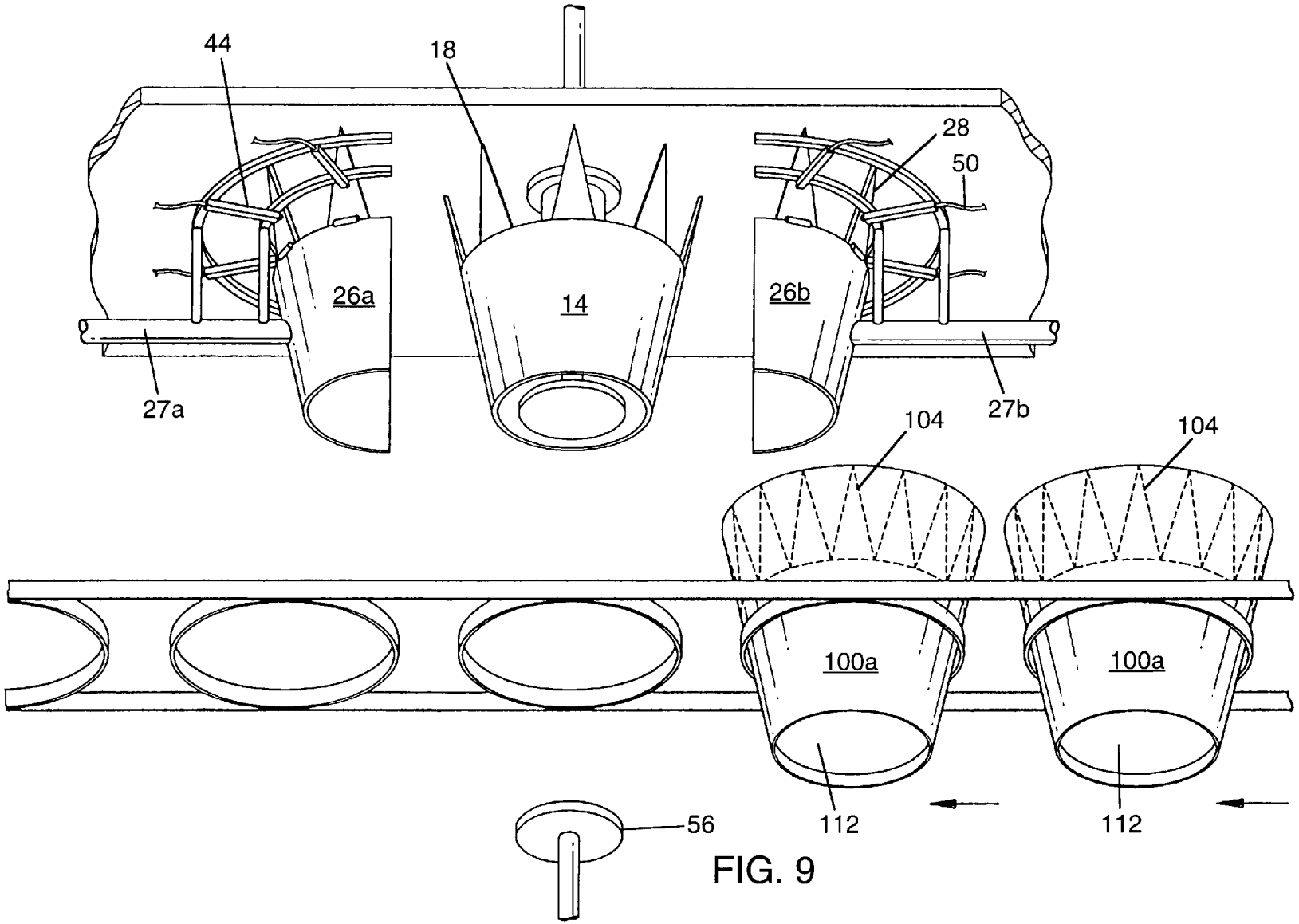
FIG. 9 is an elevation view showing a loading track for box blanks having a flat, pre-sealed bottom.
Figure 10:
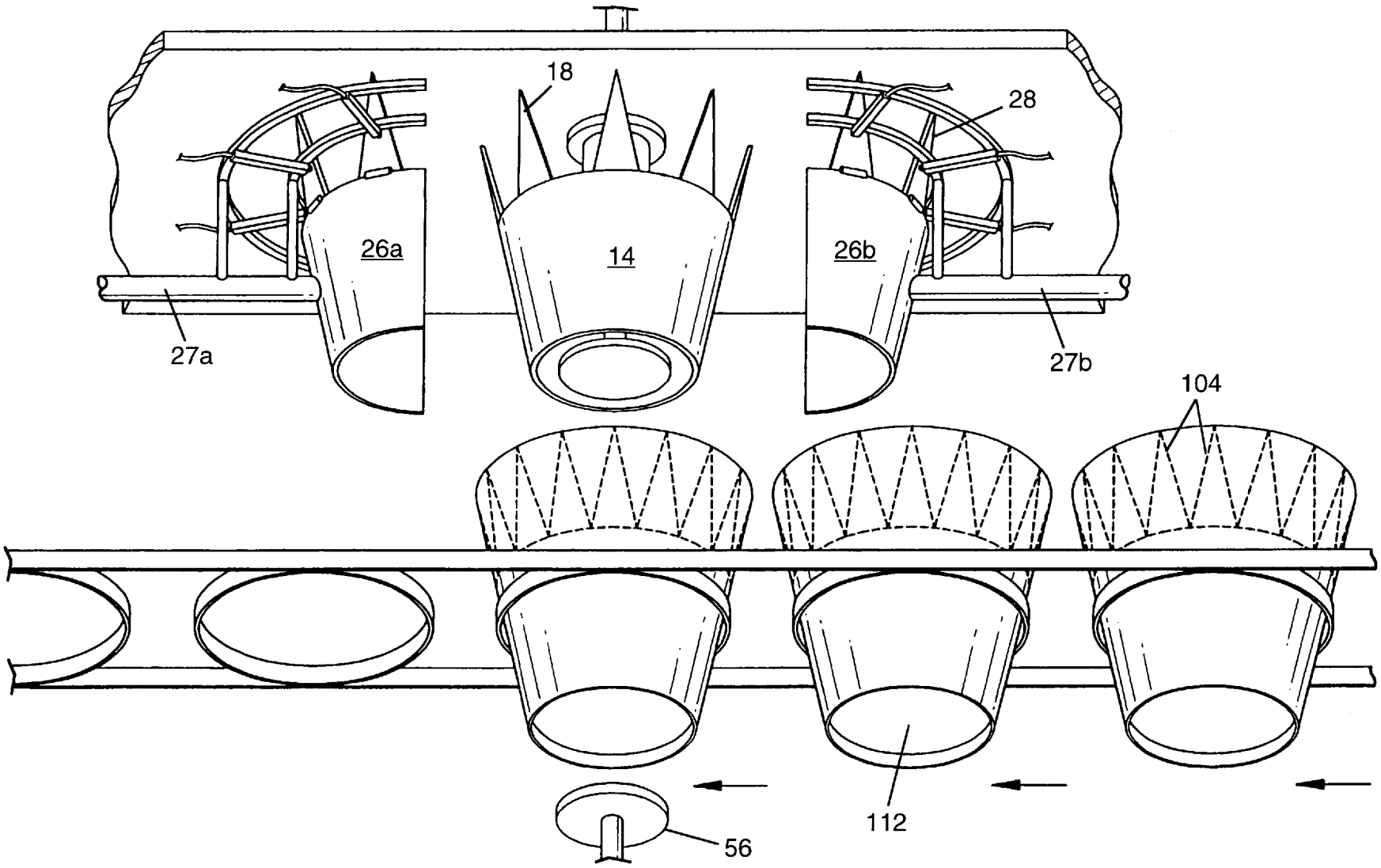
FIG. 10 is an elevation view that shows the progression of box blanks on the loading track for positioning directly adjacent the pedestal.
Figure 11:
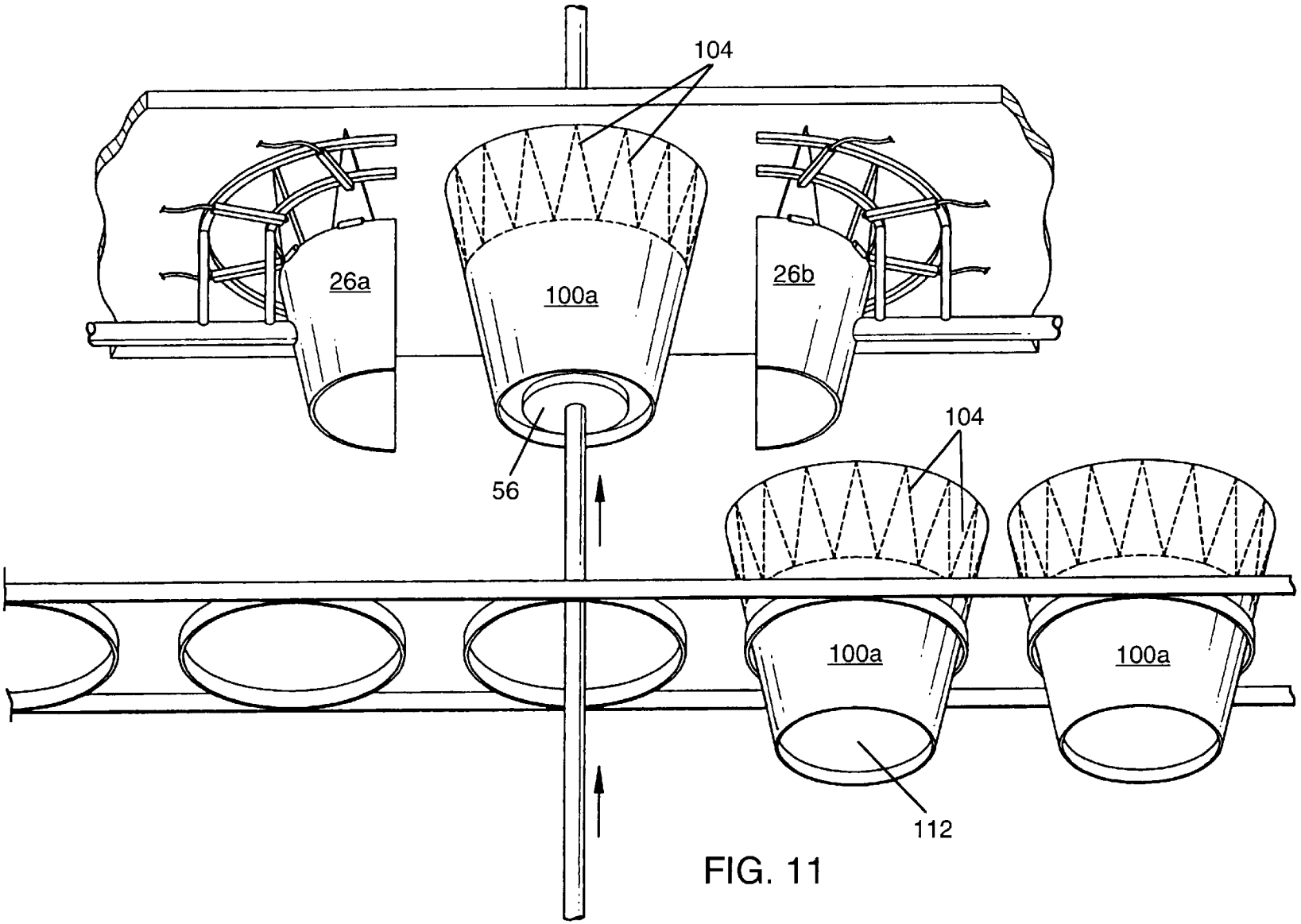
FIG. 11 shows a box blank installed on the pedestal by the bottom driver.

Reference to FIG. 9, FIG. 10 and FIG. 11, indicates that in an alternative embodiment for the boxes, the box blanks 100A designated for installation on the pedestal 14 may have a flat, pre-sealed bottom section 112. The blanks 100 or 100A proceed on a loading track for positioning directly adjacent the pedestal 14, whereupon each box blank 100 or 100A is installed on the pedestal 14 by the bottom driver 56.

Figure 12:
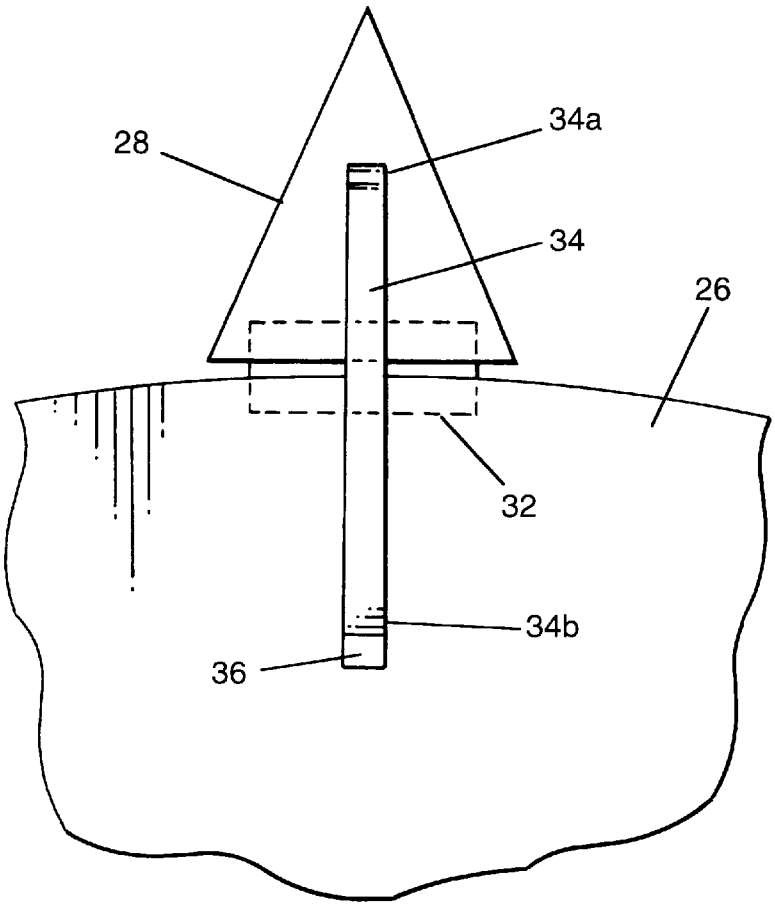
FIG. 12 is an elevational view of a press finger.
Figure 13:
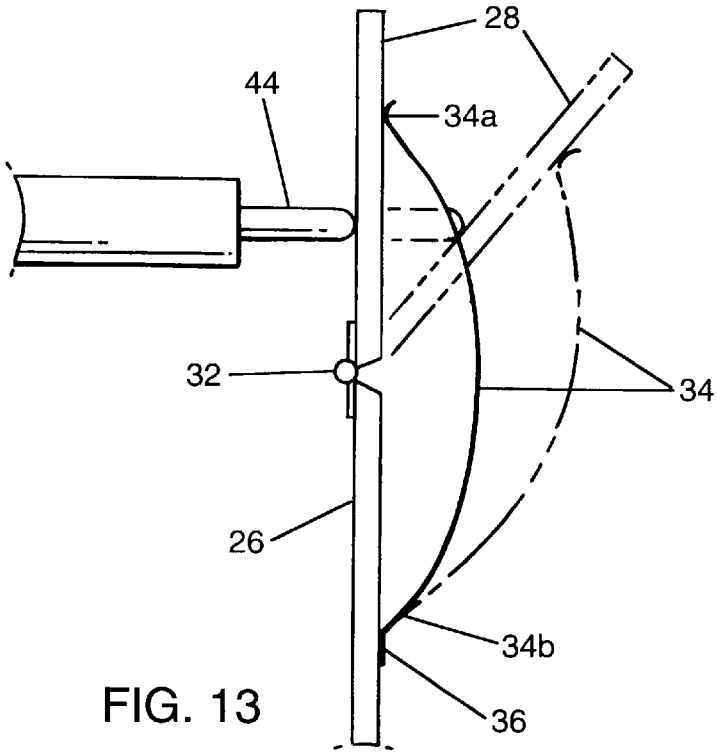
FIG. 13 is an elevation taken at right angles to the view shown in FIG. 12.
Figures 14, 15, 16:
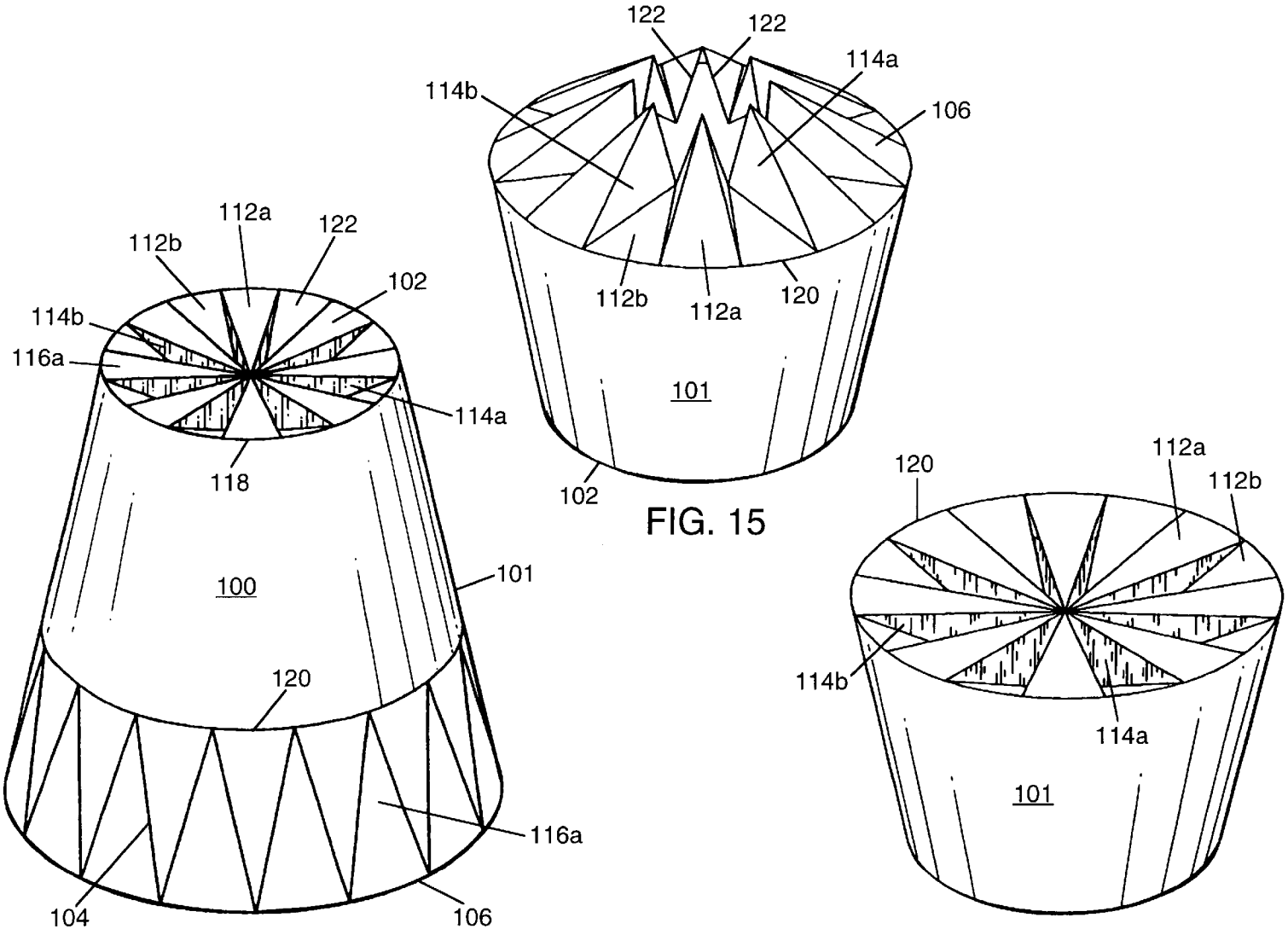
FIG. 14 is a perspective view of the precreased frusto-conical container blank seen in FIG. 8 with the top flap completely folded inward with a plurality of pyramidal fanfolds crimped to form a closure.
FIG. 15 is perspective view of the container blank of FIG. 14 showing a partially closed end.
FIG. 16 is a perspective view of the container with both ends completely closed.

As noted in FIGS. 12 and 13, each of the press fingers is pivotally joined to the press sides by a flat hinge 32. The hinge is designed to swing through an arc of about 180° from the closed to the fully open position. When open, each of the press fingers 28 typically is coplanar with the sides 26A, 26B of the press. Shown is an external steel spring 34 with one end 34A in contact with the finger 28 and the other end 34B secured to the press side 26A by suitable means such as a spot weld 36. In operation, each press finger 28 is pivoted about flat hinge 32 from the vertical position in contact with the periphery of the container to a predetermined position (shown in outline) where the periphery is creased. Then, as the fluid pressure against the pin 44 is released, the spring 34 on the side of the press finger 28 opposite the pin urges the finger back to its normal vertical position. p Referring now to FIGS. 14–16, a container blank which has been scored, creased and folded according to the teachings of the present invention is shown. The blank 100 comprises a body portion 101, a closed first end flap 102 and second creased but unfolded end flap 106. The flaps are creased along fold line 118, 120 to fold in toward the axial center line of the blank. FIG. 14 shows the first flap 102 closed in on itself. The flap is composed of a plurality of fanfold ribs in the shape of pyramids 116A, formed by the folding of the flap along the creased score lines 104. Each rib is composed of a first set of triangles 112A, 112B and a second set of triangles 114A, 114B. All of the triangles are of equal size and all are in the form of isosceles triangles, the height of which is equal to the radius of the closure circle. The first set of triangles are formed with their bases along fold line 118. Their planes diverge from one another as they extend radially inwardly from the fold line to the center axis of the container. Conversely, the second set of triangles 114A, 114B have their bases along the axis and their planes diverge from one another as they extend radially outwardly from the axis toward the fold line, terminating at the apex between the bases of the adjacent triangles in the first set 112A, 112B along the fold line 118. Changes and modifications can be made by those skilled in the art without departing from the spirit of the present invention.

In like manner, FIGS. 15 and 16 show the container of FIG. 14 set upon the closed flap 102. FIG. 15 shows the second flap 106 folded upon itself preparatory to complete closure. All of the first set of triangles 112A, 112B have been folded along the linear fold line 120 extending around the periphery of the container 101, and extend radially inwardly the center of the container. Their respective planes diverge from one another as they extend from fold line toward the axis. The second set of triangles 114A, 114B connect the first set of triangles with one another. The bases 122 of the second set of triangles converge toward one another to form a crimp line along the axis of the container thereby forming a complete closing of the flap upon itself. When the flap is completely closed as shown in FIG. 16, the second set of triangles is at right angles to the first set.

Unlike many of the prior art closures, the closures formed according to the present invention can be repeatedly opened and closed with minimal wear. The fold lines and the edges of the container blank are coplanar and linear with no need to form curved, scalloped or sawtooth edges. The individual pyramids do not overlap and fold over one another, nor is there any need to twist the container relative to the flap when closing the container.

The preceding detailed description should be considered exemplary in nature and not limited to the scope and spirit of the invention as set forth in the appended claims.

I claim:

1. A container blank in the shape of a cylindrical frustum and comprising a body having at least one circular opening at one end thereof, said container blank containing a plurality of creases that define a plurality of contiguous isosceles triangles to be folded into fanfold ribs around said at least one opening, said creases formed by the steps of creating a plurality of score lines around the periphery of the at least one opening to form the contiguous triangles, placing the container blank in a creasing machine containing a plurality of triangular fingers, whereby the fingers are in registry with the contiguous triangles, and actuating the fingers to form creases in the blank along the score lines around the at least one said opening.

2. The container blank according to claim 1 wherein the fingers are composed of a plurality of press fingers spaced apart from one another around an outside surface of the at least one opening of the container blank, and an equal number of pedestal fingers intermediate the press fingers around an inside surface of the container blank.

3. The container blank according to claim 2, wherein the press fingers cause the periphery of the at least one opening to move in on itself, and the pedestal fingers resist the movement of the periphery to create creases along the scored lines.

4. A container having a closure at one end composed of a plurality of fanfold ribs around the periphery of the container, said ribs formed by the steps of:

a. preparing a container blank in the form of a cylinder or a frustum, b. creating a plurality of score lines around the periphery of the container blank to form contiguous triangles, c. placing the container blank in a creasing machine containing a plurality of triangular hinged fingers whereby the fingers are in registry with the triangles, d. activating the fingers to form creases along the score lines, e. removing the container blank from the machine, and f. folding the periphery of the container blank along the creases to form a plurality of inwardly directed ribs serving as the closure for the container.

5. The container according to claim 4, wherein the container blank has a circular cross section and each of the triangles around the periphery is an isosceles triangle having a height equal to the radius of the closure.

6. A generally cylindrical or frustoconical container having a central axis and peripheral borders at either end defining a fold line, at least one end closable with a fanfold closure, the closure comprising a plurality of pyramidal segments, each segment composed of a first set of two isosceles triangles with their bases forming a portion of the end fold line, and a second set of two isosceles triangles with their bases forming a crimp line extending along the axis of the container, all of the triangles having a height equal to the radius of the container closure.

7. The container of claim 6 wherein the bases of the triangles in the first set are contiguous to one another along the end fold line, and the triangles form divergent planes as they extend from the bases to the axis.

8. The container of claim 7 wherein the two triangles in the second set diverge from one another as they extend from the container axis to the end fold line, said triangles terminating along the fold line at the intersection between the bases of the first set of triangles.

9. The container according to claim 6 wherein the first set of two triangles are at right angles to the second set of two triangles.

10. The container according to claim 9, wherein the pyramidal segments are in non-overlapping relationship to one another.

11. The container according to claim 10, wherein each end fold line is in a single plane.

12. The container according to claim 11, wherein the peripheral edge of the container before forming a closure is in a single plane.

13. The container blank according to claim 12, wherein all folds are visible upon closure of the container.

14. The container according to claim 13, wherein bases of the first set and the second set of isosceles triangles are linear.

15. A container having a closure at one end composed of a plurality of fanfold ribs around the periphery of the container, said ribs formed by the steps of:

a. preparing a container blank in the form of a cylinder or a frustum, b. creating a plurality of score lines around the periphery of the container blank to form contiguous triangles, c. placing the container blank in a creasing machine containing a plurality of triangular hinged fingers whereby the fingers are in registry with the triangles, d. activating the fingers to form creases along the score lines, e. removing the container blank from the machine, and, f. folding the periphery of the container blank along the creases to form a plurality of inwardly directed ribs serving as the closure for the container;

wherein the container has a circular cross section and each of the triangles around the periphery is an isosceles triangle having a height equal to the radius of the closure.

16. The container according to claim 15, wherein the fingers are composed of a plurality of press fingers spaced apart from one another around the outside of the container blank, and an equal number of pedestal fingers intermediate the press fingers around the inside of the container blank.

17. The container of claim 16, wherein the creasing machine comprises an inner, fixed pedestal form adapted to receive the blank and an outer form fitted over the blank on the pedestal, and a pneumatic means for activating the fingers.

* * * * *